US005235928A

United States Patent [19]

Shank, Jr.

[11] Patent Number: 5,235,928

[45] Date of Patent: Aug. 17, 1993

[54] TOWED SUBMERGIBLE, COLLAPSIBLE, STEERABLE TANK

[75] Inventor: Samuel R. Shank, Jr., Arnold, Md.

[73] Assignee: The United States of America as represented by the Secretary of the Navy, Washington, D.C.

[21] Appl. No.: 953,369

[22] Filed: Sep. 30, 1992

[51] Int. Cl.[5] ..... B65D 89/10

[52] U.S. Cl. ..... 114/244; 114/246; 114/253; 114/257; 440/88

[58] Field of Search ..... 114/242, 243, 244, 245, 114/246, 247, 253, 254, 257, 321, 256; 440/88

[56] References Cited

U.S. PATENT DOCUMENTS

| | | | |
|---|---|---|---|
| 1,968,577 | 7/1934 | Taylor | 114/246 |
| 3,469,552 | 9/1969 | Patrick | 114/246 |
| 3,611,977 | 10/1971 | Mosvold | 114/246 |
| 3,779,196 | 12/1973 | Knaus et al. | 114/256 |
| 4,108,101 | 8/1978 | Schirtzinger | 114/321 |
| 4,506,623 | 3/1985 | Roper et al. | 114/321 |

FOREIGN PATENT DOCUMENTS

| | | | |
|---|---|---|---|
| 1159028 | 6/1958 | France | 114/257 |

*Primary Examiner*—David M. Mitchell
*Assistant Examiner*—Stephen P. Avila
*Attorney, Agent, or Firm*—Charles D. Miller

[57] ABSTRACT

A towable tank for holding a liquid is collapsible, submergible, and steerable. A bladder for holding a liquid is disposed in a housing having openings formed therein. Horizontally mounted diving planes on the housing cause the tank to submerge when under tow. Hydrostatic pressure exerted on the bladder by water entering the openings in the housing causes the liquid in the bladder to be pumped to a liquid user. A tow line from the towing vehicle is connected to a tow bar. The tow bar is connected through a connecting rod to a vertically mounted crankshaft. The crankshaft is connected to a steering plane mounted on the exterior of the housing. While the tank is under tow, the steering plane aligns with the longitudinal axis of the tank. A spring attached between the crankshaft and housing causes the steering plane to steer the tank away from a direction being towed when the towing force is removed.

9 Claims, 2 Drawing Sheets

TOWED SUBMERGIBLE, COLLAPSIBLE, STEERABLE TANK

The invention described herein may be manufactured and used by or for the Government of the United States of America for governmental purposes without the payment of any royalties thereon or therefor.

BACKGROUND OF THE INVENTION

The present invention relates in general to a towed tank for holding a liquid, and in particular to a towed fuel tank that is submergible, collapsible, and steerable.

Generally, all fuel burned by a ship is carried on board. The amount of fuel carried on board depends upon the design range of the ship. A typical surface combatant will be about 20% fuel by weight. The fuel load has a great impact on the design of the ship in regard to space, weight, and the ultimate size and cost of the ship. The ship design is often limited by the fuel load, which must be carried on board.

Fuel is stored low in a ship due to stability requirements. As the fuel is used, it generally is replaced by seawater, to maintain the ship's static stability. Often, depending on the design range, significant amounts of fuel must occupy otherwise useable space, thus increasing the size and cost of the ship.

Naval ships are designed for an expected life period of 30 years and longer. The design of naval ships is performed 5-10 years prior to their use and is based on projected mission requirements. A major element of ship design is range. The design range of a ship limits the utility of that ship to missions whose range is less than or equal to the design range. As a ship ages, its fuel efficiency generally decreases because of the decreasing efficiencies of the fuel users, such as boilers, internal combustion engines, etc. Thus, as a ship ages, it becomes less likely that it can meet the range requirements of a modern mission.

Furthermore, naval ships are refueled at sea by oilers. If a particular mission requires stealth, then the mission may be jeopardized by the need for a refueling ship to enter the stealth zone.

SUMMARY OF THE INVENTION

It is an object of the invention to provide a towable fuel tank for extending a ship's range.

It is another object of the invention to provide a towable fuel tank that is submergible and collapsible.

It is a still further object of the invention to provide a towable fuel tank that is steerable.

These and other objects and advantages of the present invention are realized in a towable tank for holding a liquid that includes a housing with openings formed therein; a collapsible bladder for holding a liquid that is disposed in the housing; rotatable diving planes mounted on an exterior surface of the housing and rotatable about a generally horizontal axis; a tow bar for towing the tank; a crankshaft vertically mounted in a front end of the housing; a connecting rod connected at one end to the tow bar and at another end to the crank; and at least one steering plane mounted on the exterior surface of the housing and connected to an end of the crankshaft, the steering plane being rotatable about a generally vertical axis. Preferably, the towable tank also includes a spring attached at one end to the crank and at another end to the housing.

The invention may also be characterized as a towable tank for holding fuel for a towing vessel comprising a bladder, a housing and a fuel line. The bladder is flexible to the extent that it collapses under pressure when the fuel is extracted from the tank during towing thereof by the towing vessel. The housing contains the bladder and has at least one aperture therein for permitting seawater to enter and contact the outer surface of the bladder. The specific gravity of the fuel is less that the specific gravity of seawater. The fuel line communicates fuel in the bladder to the towing vessel. As a result, hydrostatic pressure on the bladder when submerged in seawater forces fuel in the bladder through the fuel line to the towing vessel.

BRIEF DESCRIPTION OF THE DRAWINGS

The present invention will be described in reference to certain preferred embodiments and the attached figures which are hereby expressly made a part of the specification.

DETAILED DESCRIPTION OF THE PREFERRED EMBODIMENTS

The present invention provides a towable fuel tank that is submergible, collapsible, and steerable. The tank can be used to extend the range of fossil fuel burning navy ships without making any changes to their design or compromising their capabilities or seaworthiness. The towable tank provides the most inexpensive means of extending a ship's range. The tank reduces the number of rendezvous with oilers, which is particularly important in wartime. By using the inventive tank, new ships can be designed to carry optimum fuel loads while the tank can be used to augment their fuel requirements on a particular mission. Thus, new ships can be built smaller and cheaper while being more mission flexible. The present invention can provide similar benefits for non-nuclear submarines and civilian vessels. In addition to fuel, the present invention can be used to carry various payloads typical of surface combatants. Therefore, the tank can extend either the range or payload capability of a ship.

Figure 1:
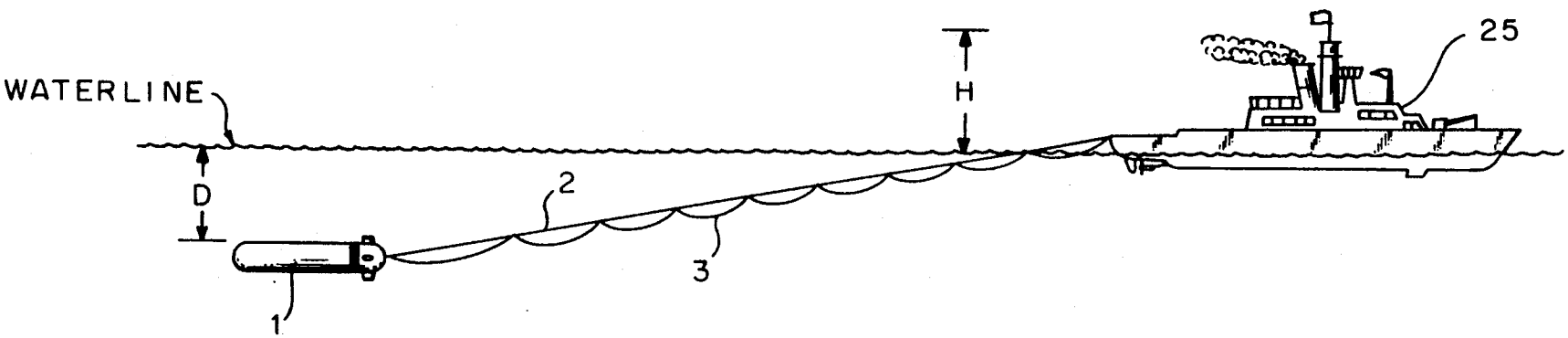
FIG. 1 shows the invention in use under water.

FIG. 1 shows the tank 1 being towed by a ship 25. A tow line 2 connects the towing ship 25 to the tank 1. A fuel line 3 between the tank 1 and the ship 25 allows fuel in the tank to be transferred to the ship. It is also possible to connect other lines such as electric and vent lines (not shown) from the tank to the ship.

Figure 2:
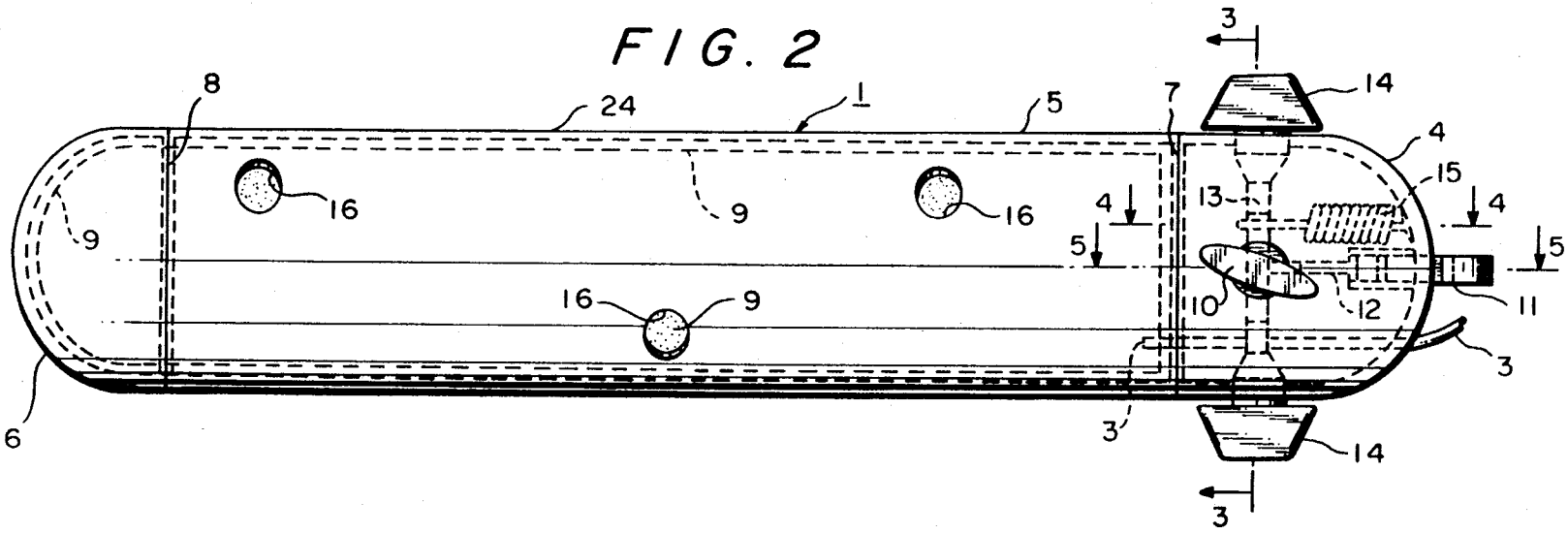
FIG. 2 is a side view of the invention.
Figure 5:
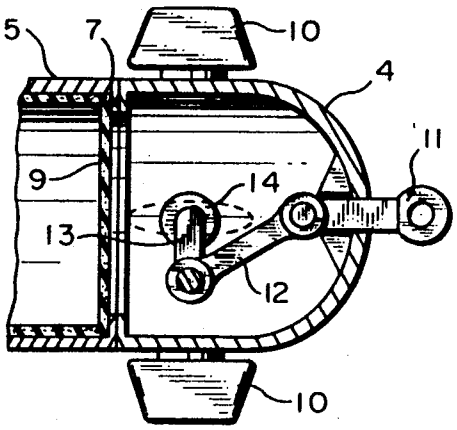
FIG. 5 is a fragmentary cross-sectional view of FIG. 2 taken along the line 5—5.
Figure 4:
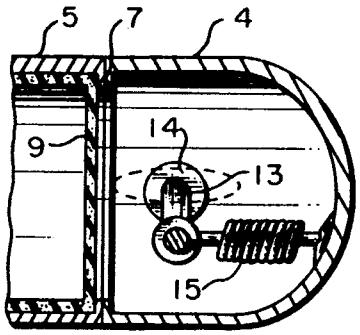
FIG. 4 is a fragmentary cross-sectional view of FIG. 2 taken along the line 4—4, but omitting the connecting rod and tow bar for clarity.
Figure 3:
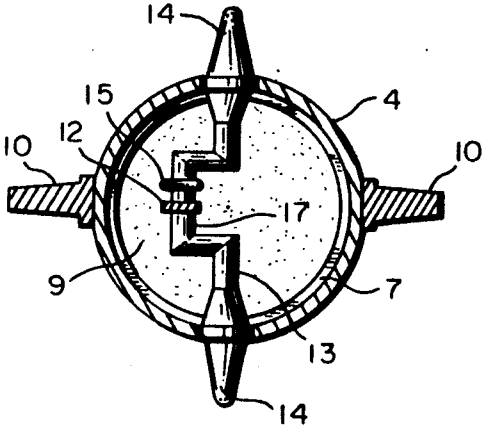
FIG. 3 is a cross-sectional view of FIG. 2 taken along the line 3—3.

As shown in FIG. 2, a housing 24 forms the outer shell of the tank The housing 24 is preferably generally cylindrical in shape. In a preferred embodiment, the housing 24 includes a nose cone 4 at a front end of the tank, a cylinder 5 behind the nose cone and a tail cone 6 on the rear of the tank. The nose cone 4 may be bolted to the cylinder 5 by means of mating internal flanges 7. Likewise, the tail cone 6 may be bolted to the cylinder 5 by means of mating internal flanges 8 (bolts are not shown). The housing 24 is made of steel or a composite material of suitable strength. The housing 24 also includes at least one opening 16 which will be described in more detail below.

A collapsible bladder 9 is disposed inside the housing 24 and contains the fuel or other liquid being stored in the tank. Preferably, the bladder 9 is contained in the tail cone 6 and cylinder 5. The bladder 9 is excluded from the nose cone 4 because the nose cone 4 contains moving parts. The bladder 9 may be excluded from the nose cone 4 by means of the circular flange 7. The bladder 9 is made of a rubber or plastic material, or any other material which is collapsible, possesses the strength required to hold the liquid being stored, and does not deteriorate by contact with the liquid being stored.

The bladder 9 collapses as the fuel is removed and seawater enters the housing 24 through the openings 16 in the housing. Because the fuel has a specific gravity of about 0.82 while that of seawater is about 1.03, the fuel will automatically flow into the ship when the tank is at a sufficient depth.

As shown in FIG. 1, the height (H) above sea level that a column of fuel will be lifted is a function of the fuel's specific gravity (SG) and the depth (D) of the tank, specifically: $H=(1.03-SG)\times(D/SG)$.

The openings 16 are not limited to any specific size or location in the housing 24. At a minimum, however, the aggregate area of the openings 16 must be large enough so that the pressure of the seawater on the bladder 9 is not restricted. Also, the openings 16 should be distributed widely over the surface of the housing to ensure equivalent pressure on the whole bladder.

For shallow submergence or surface operation an optional fuel pump (not shown) is attached to the fuel line 3 within the housing 24. The fuel pump will require that an electric service cable be attached to the tank in a manner similar to the fuel line 3.

Rotatable diving planes 10 are mounted on an exterior surface of the housing 24, preferably the nose cone 4, and are rotatable about a generally horizontal axis. The variable position diving planes 10 provide the submerging function of the tank. The diving planes 10 are adjusted before the mission to provide a desired depth for the tank at a specified ship speed. The tank is designed to have positive buoyancy over its entire operating range. Therefore, submergence of the tank is obtained dynamically by the diving planes 10 while the tank is being towed. The tank will surface when the towing force is removed. The diving planes 10 are manually adjustable. The details and construction of the adjustable diving planes 10 are analogous to the diving planes on a submarine.

The optional steering function of the tank is accomplished in the following manner. The tow bar 11 extends through the front end of the housing 24. The forward end of the tow bar 11 is attached to the tow line 2. The rear end of the tow bar 11 is attached to a connecting rod 12. The connecting rod 12 connects the tow bar 11 to a crankshaft 13. The crankshaft 13 is vertically mounted in the housing 24, preferably in the nose cone 4. The towing force is applied to the tow bar 11, through the connecting rod 12 and to the crankshaft 13. The crankshaft 13 includes a U-shaped portion or crank portion 17 to which the connecting rod 12 is attached. The crankshaft 13 extends vertically through the housing 24 and is connected to and controls the position of the steering planes 14. The steering planes 14 are rotatable about a generally vertical axis. A spring 15 is attached at one end to the crank portion 17 and at the other end to the forward interior surface of the housing 24.

While the tank is being towed, the towing force that is applied to the crankshaft 13 maintains the steering planes 14 in a position parallel to a longitudinal axis of the tank. The towing force also acts to compress the spring 15. When the towing force is removed, the spring force automatically rotates the steering planes 14 to a position which intersects the axis of the tank, thereby causing the tank to turn from the direction in which it was being towed.

The towing force is used to steer the tank straight in the direction being towed through the action of the steering planes 14. When the towing force is removed (as in a crash astern reversal of the towing vehicle) the tank will turn away from the direction being towed due to rotation of the steering planes 14 by the spring 15, thus preventing the tank from drifting and colliding with the ship. Additionally, when the towing force is removed, the tank will surface due to removal of the dynamic diving force.

The combined action of the tow bar 11, the connecting rod 12, the crankshaft 13, the spring 15, and the steering planes 14 provide the tank with a fail-safe integrated towing and steering mechanism.

While the liquid being stored in the tank has been generally referred to as fuel, it is possible that other liquids that are needed on board a ship may also be carried.

Although the present invention has been described in reference to certain preferred embodiments, numerous alterations and variations are possible without departing from the spirit and scope of the invention.

What is claimed is:

1. A towable tank for holding liquid, comprising;

a housing having openings formed therein and a front end;

a collapsible bladder for holding liquid and disposed in said housing;

rotatable diving planes mounted on an exterior surface of said housing and rotatable about a generally horizontal axis;

a tow bar for towing said tank, wherein said tow bar is connected to said housing at said front end;

a crankshaft having a crank portion and being vertically mounted in said front end of said housing;

a connecting rod connected at one end to said tow bar and at another end to said crank portion; and at least one steering plane mounted on said exterior surface of said housing and connected to an end of said crankshaft, wherein said at least one steering plane is rotatable about a generally vertical axis.

2. The towable tank of claim 1, wherein said housing is generally cylindrical in shape.

3. The towable tank of claim 1, further comprising a tow line connected at one end to said tow bar and at another end to a towing vehicle.

4. The towable tank of claim 1, further comprising a liquid conduit fluidly connected at one end to said bladder and at another end to a user of said liquid.

5. The towable tank of claim 1, further comprising a spring attached at one end to said crank portion and at another end to said housing.

6. The towable tank of claim 1, wherein said housing comprises a nose cone at said front end of said housing, a cylinder connected to said nose cone, and a tail cone connected to said cylinder.

7. The towable tank of claim 6, wherein said rotatable diving planes and said at least one steering plane are mounted on an exterior surface of said nose cone; said tow bar is inserted through said nose cone, and wherein said crankshaft is disposed in said nose cone.

8. The towable tank of claim 7, further comprising means for excluding said bladder from said nose cone.

9. The towable tank of claim 8, wherein said means for excluding comprises a flange.

* * * * *